US011427020B2

(12) United States Patent
Knauf et al.

(10) Patent No.: US 11,427,020 B2
(45) Date of Patent: Aug. 30, 2022

(54) METHOD AND SYSTEM FOR IMPROVED SHEET RUNNING CONTROL IN A SHEET-FED PRINTING MACHINE

(71) Applicants: HEIDELBERGER DRUCKMASCHINEN INTELLECTUAL PROPERTY AG & CO. KG, Wiesloch (DE); microsonic GmbH, Dortmund (DE)

(72) Inventors: Stefan Knauf, Heidelberg (DE); Helmut Buck, Schriesheim (DE); Juergen Ritz, Dielheim (DE); Veronika Himmelsbach, Heidelberg (DE); Manuel Janocha, Schriesheim (DE); Johannes Schulte, Dortmund (DE); Thorsten Paesler, Waltrop (DE)

(73) Assignee: Heidelberger Druckmaschinen Intellectual Property AG & Co. KG, Wiesloch (DE)

( * ) Notice: Subject to any disclaimer, the term of this patent is extended or adjusted under 35 U.S.C. 154(b) by 0 days.

(21) Appl. No.: 17/095,962

(22) Filed: Nov. 12, 2020

(65) Prior Publication Data

US 2021/0138805 A1 May 13, 2021

(30) Foreign Application Priority Data

Nov. 12, 2019 (DE) ..... 10 2019 130 441

(51) Int. Cl.
*B41J 13/00* (2006.01)

(52) U.S. Cl.
CPC ..... *B41J 13/0009* (2013.01)

(58) Field of Classification Search
CPC ..... B41J 11/0095; B41J 13/0009; B41F 21/10
See application file for complete search history.

(56) References Cited

U.S. PATENT DOCUMENTS

| | | | |
|---|---|---|---|
| 4,376,413 | A | 3/1983 | Kuroda |
| 5,186,105 | A | 2/1993 | Emrich et al. |
| 7,478,806 | B2 | 1/2009 | Buck et al. |
| 10,131,137 | B2 | 11/2018 | Henn et al. |

FOREIGN PATENT DOCUMENTS

| | | | |
|---|---|---|---|
| AT | 11507 | E | 2/1985 |
| DE | 4112222 | A1 | 10/1992 |
| DE | 102006003339 | A1 | 8/2006 |
| DE | 102016203479 | A1 | 9/2017 |
| DE | 102017220039 | B3 | 8/2018 |

*Primary Examiner* — Lam S Nguyen
(74) *Attorney, Agent, or Firm* — Laurence A. Greenberg; Werner H. Stemer; Ralph E. Locher

(57) ABSTRACT

A method for computer-aided sheet running control in a sheet-fed printing machine includes, during a printing operation, using a measuring sensor to detect a printed sheet in the printing machine and using an activation sensor to initiate measuring performed by the measuring sensor by emitting an activation signal. The activation sensor is mechanically fixedly installed without adjustment, and temporal deviations of the activation signal are determined and compensated. A system for computer-aided sheet running control in a sheet-fed printing machine is also provided.

10 Claims, 7 Drawing Sheets

METHOD AND SYSTEM FOR IMPROVED SHEET RUNNING CONTROL IN A SHEET-FED PRINTING MACHINE

CROSS-REFERENCE TO RELATED APPLICATION

This application claims the priority, under 35 U.S.C. § 119, of German Patent Application DE 10 2019 130 441, filed Nov. 12, 2019; the prior application is herewith incorporated by reference in its entirety.

BACKGROUND OF THE INVENTION

Field of the Invention

The present invention relates to a method for improved sheet running control in a sheet-fed printing machine by using a mechanically fixedly installed activation sensor.

The invention lies in the technical field of sheet transport in printing machines.

The sheet running control in sheet-fed printing machines has the function of detecting when a sheet is lost in a printing unit or between units, in order to avoid soiling of the machine by ink being applied to the impression cylinder or, in an extreme case, the machine being damaged. For that purpose, nowadays a system including two sensors is used: an actual sheet running sensor, which detects an overhang of the sheet in grippers, and an activation sensor. The latter initiates the measuring performed by the sheet running sensor at a specific angle by detecting a tag, a flag or a lug rotating with it on the cylinder and allowing itself to be displaced in the circumferential direction for the adjustment. The specific angle must however be adjusted with a certain tolerance for correct functioning of the sheet running sensor. That takes place by displacing the activation sensor in the circumferential direction.

The sheet running sensor is either constructed as an optical measuring sensor, which detects objects in a detection range, or as an ultrasonic measuring sensor, which detects a reflector attached to the cylinder when it is not covered by the sheet. In the case of an incorrect or wrong adjustment of the activation sensor, the measuring sensor either sporadically does not detect an object and stops the machine even though a sheet is present—in which case the adjustment is set too early, or the cylinder is always detected even when no sheet is present—in which case the adjustment is set too late. In the latter case, the monitoring function is no longer ensured at all.

The exact adjustment of the activation sensor is however a process that is time-consuming and susceptible to errors, during installation as well as in the case of servicing. The activation by the machine controller requires a vibration model of the machine and is therefore very complex. The manifestation of the machine vibrations depends in that case on many parameters, for which functional relationships must be simulated or measured. Those parameters include for example the temperature of the machine, load, operating state, machine configuration, possible properties of printing inks, lubrication, position of the main drive, etc. For that reason, it would be of advantage to reduce that complexity.

During installation, there are therefore auxiliary and operational measures for the mechanical adjustment of the activation sensors, in order to facilitate the work. During installation, the adjustment is carried out wherever possible on individual printing units, with good accessibility of the sensors and holders during the adjustment. In the case of servicing, that is not possible, however.

German Patent DE 10 2017 220 039 B3 also describes in that respect a method that allows the activation sensor to be omitted and uses the machine controller for carrying out the activation by using a torsion model. Because of the torsion of the machine and the dependence on multiple parameters, such as machine load, units under pressure or not, temperature, etc., the determination of those parameters of the torsion model of the machine is however likewise very complex and in the worst case, because of tolerances, must be carried out for each individual machine on its own.

BRIEF SUMMARY OF THE INVENTION

It is accordingly an object of the invention to provide a method and a system for improved sheet running control in a sheet-fed printing machine, which overcome the hereinafore-mentioned disadvantages of the heretofore-known methods and systems of this general type and which is more accurate and is less susceptible to errors than the methods and systems known from the prior art.

With the foregoing and other objects in view there is provided, in accordance with the invention, a computer-aided method for sheet running control in a sheet-fed printing machine, wherein, during printing operation, a measuring sensor detects the sheet in the printing machine and an activation sensor initiates the measuring performed by the measuring sensor by an activation signal, wherein the activation sensor is mechanically fixedly installed without adjustment and temporal deviations of the activation signal are determined and compensated.

The most important point of the method according to the invention is that the activation sensor no longer has to be newly adjusted to achieve exact activation of the measuring sensor, but instead is mechanically fixedly installed in the printing machine. This dispenses with the need for adjustment of the activation sensor, which is extremely susceptible to errors and sometimes inaccurate and, apart from reducing a possible source of errors for the method for sheet running control, also reduces the corresponding expenditure of time for the adjustment. The fixing of the activation sensor has the effect that it of course no longer detects an incoming sheet at the ideal point in time, which would result in delayed or premature activation of the measuring sensor. In order to compensate for this and activate the measuring sensor at the correct point in time, this temporal deviation of the activation signal triggered by the activation sensor must therefore be determined. If the deviation of the activation signal is then known, the measuring performed by the measuring sensor can be adapted without any problem with respect to the deviation determined. The activation sensor is positioned and fixed when it is installed in such a way that its activation signal is always output prematurely.

Advantageous, and therefore preferred developments of this invention emerge from the associated subclaims and also from the description and the associated drawings.

A preferred development of the method according to the invention in this case is that the temporal deviations of the activation signal are determined by a duration of the activation signal at a constant speed of the sheet-fed printing machine being scaled by a factor. It is therefore decisive for the calculation of the temporal deviation of the activation signal to measure the duration of the activation signal at a constant speed of the sheet-fed printing machine and scale it by a calculated compensation factor in such a way that the temporal deviations of the activation signal for the duration of the activation signal are correspondingly also taken into account.

A further preferred development of the method according to the invention in this case that the computer detects the duration of the activation signal at a constant speed of the sheet-fed printing machine during a learning run, separate from the normal printing operation of the sheet-fed printing machine, at the constant speed of the sheet-fed printing machine. This is required because the sheet-fed printing machine of course does not always print at a specific constant speed during its normal printing operation. For the calculation of the temporal deviation of the activation signal that is to be carried out, it is required however to detect the duration of the activation signal at a known and therefore constant speed, in order then to be able to carry out the scaling by these known values for taking the temporal deviations into account.

A further preferred development of the method according to the invention in this case is that the computer determines during the printing operation of the sheet-fed printing machine the current speed of the sheet-fed printing machine by forming the ratio between the detected duration of the activation signal at a constant speed in the learning run and a measured duration of the activation signal during printing operation. For the determination of the temporal deviation of the activation signal, it is therefore required to determine the current speed in each case of the sheet-fed printing machine during printing operation. This is calculated by a ratio between the detected duration of the activation signal at a constant speed in the corresponding learning run and the duration to be measured of the activation signal during printing operation being formed. Then the temporal deviation of the activation signal can be determined from the current speed of the sheet-fed printing machine during printing operation.

A further preferred development of the method according to the invention in this case is that the factor is calculated by the ratio of the current speed of the sheet-fed printing machine during printing operation and the constant speed of the sheet-fed printing machine in the learning run being determined. As already mentioned, the determination of the temporal sequence of the activation signal takes place by using a factor scaling. The factor itself is then determined by the ratio of the specific current speed of the sheet-fed printing machine during printing operation and the known constant speed in the learning run being determined. With the calculated factor, the duration of the activation signal in the learning run, i.e. at a constant printing machine speed, can then be scaled to the value during printing operation, which takes into account the corresponding temporal deviation of the activation signal, caused by the mechanically fixedly installed activation sensor.

A further preferred development of the method according to the invention in this case is that the measuring sensor is used as a computer and determines and stores the detected duration of the activation signal at a constant speed in the learning run and the measured duration of the activation signal during printing operation. Since the measuring sensor has its own control system, usually in the form of a microcontroller or the like, this can be correspondingly used by the control system of the measuring sensor for detecting the duration of the activation signal in the learning run at a constant speed and for measuring the duration of the activation signal during printing operation for forming the already mentioned ratio or the factor. The control system of the measuring sensor then represents the computer that also directly carries out right away the corresponding factor scaling for taking into account the temporal deviation. Alternatively, the determination and compensation of the temporal deviation of the activation signal may of course also be carried out by an external computer, which then notifies the measuring sensor of the calculated temporal deviations or activates it with a corresponding delay. However, the procedure of having this carried out by the measuring sensor itself is easier and more efficient.

A further preferred development of the method according to the invention in this case is that the calculation of the factor is carried out by the measuring sensor by using stored durations of the activation signal at a constant speed in the learning run, the measured duration of the activation signal during printing operation and the constant speed of the sheet-fed printing machine in the learning run. If the detection of the duration of the activation signal in the learning run and during printing operation is carried out and stored in each case by the measuring sensor, the calculation of the factor for taking into account the temporal deviations logically also takes place in the measuring sensor.

A further preferred development of the method according to the invention in this case is that the duration of the activation signal is determined by the time during a sheet run in which the activation sensor is active or not active being detected. Direct detection of the active phase of the activation sensor has in this case the advantage that fluctuations of the machine speed when measuring during printing operation do not have adverse effects on the measurement results. Indirect detection by determining the inactive phase of the activation sensor has in turn the advantage that the electronic processing times and the operating times of the sensor that result from the scanning rate have scarcely any adverse effect, since a time period that is long in relation to the duration of the activation signal is measured.

A further preferred development of the method according to the invention in this case is that the constant speed of the sheet-fed printing machine is so low that the scanning rate of the sensors and their electronic processing times do not influence the determination of the temporal deviations of the activation signal. In principle, of course, any machine speed can be used as a constant speed in the learning run. However, with very high machine speeds, the electronic processing times and the operating times of the sensor that result from the scanning rate again come into play, since, with a correspondingly high speed of the sheet-fed printing machine and an accordingly short duration of the activation signal, they become of increasingly greater significance, and consequently can adversely influence the determination of the temporal deviations as a disturbance. Therefore, a constant speed that is as low as possible is preferred for the learning run.

With the objects of the invention in view, it is concomitantly provided that the method according to the invention is also operated on a system for sheet running control in a sheet-fed printing machine with a computer, having a mechanically fixedly installed activation sensor and measuring sensor.

Other features which are considered as characteristic for the invention are set forth in the appended claims.

Although the invention is illustrated and described herein as embodied in a method and a system for improved sheet running control in a sheet-fed printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
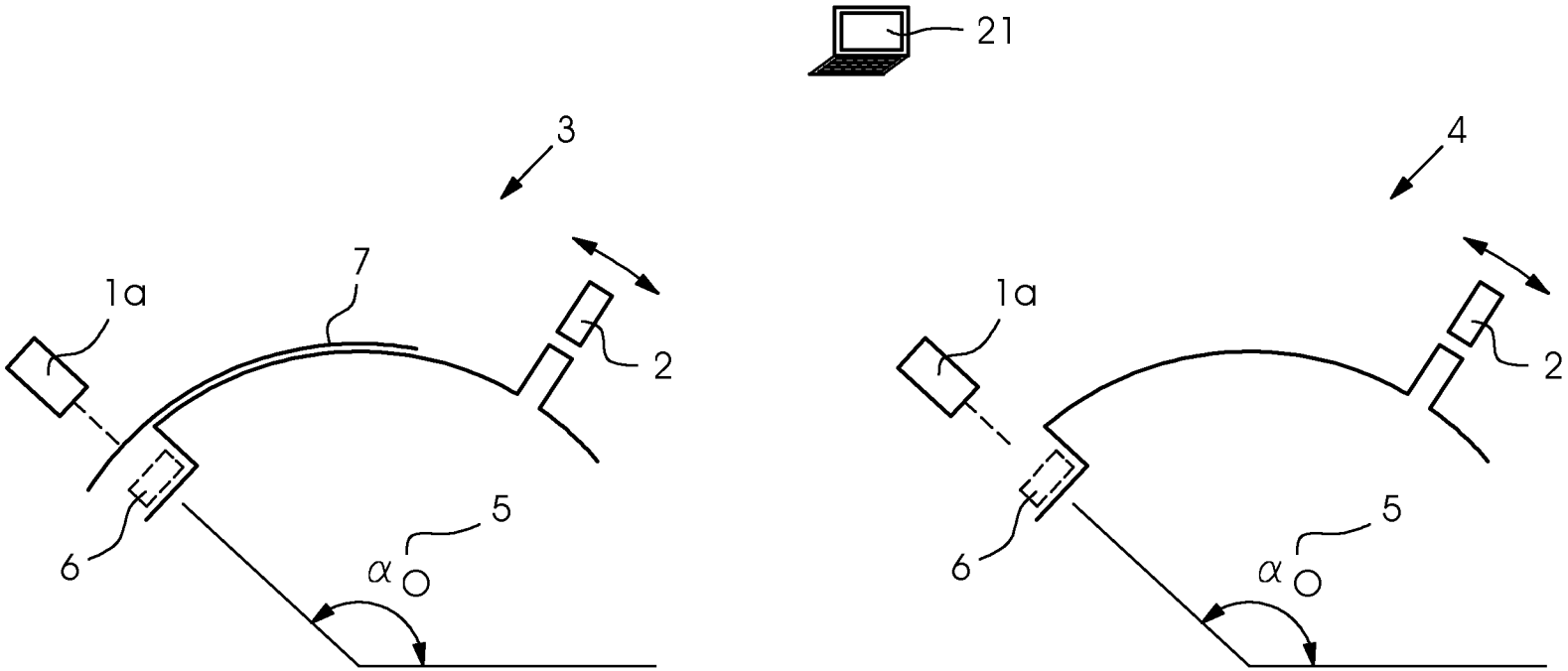
FIG. 1 is a fragmentary, diagrammatic, cross-sectional view of a prior art system including a sheet running sensor and an activation sensor.

Referring now in detail to the figures of the drawings, in which elements corresponding to one another are provided with the same reference signs, there is seen, as in the prior art, a system including an activation sensor 2 and a sheet-running measuring sensor 1*a*, 1*b*, controlled by a computer. The system used therein has two sensors, including an actual sheet running sensor 1*a*, 1*b* (referred to hereafter just as the measuring sensor), which detects an overhang of a sheet 7 in grippers, as well as an activation sensor 2 and a reflector 6 in the cylinder, at which the optical or ultrasound signal is reflected for measurement. Such a system is shown in FIG. 1. On one hand, the system provides for measuring 4 without a sheet 7, in which the signal is correspondingly reflected and it is consequently indicated that there is no printed sheet 7. On the other hand, measuring 3 with a sheet 7 is shown, where the signal is scattered by the sheet, so that the measuring indicates the presence of a printed sheet 7. In order to ensure that the system operates correctly, however, an absolutely correct setting of the activation sensor 2 is necessary. An indication of this is the correct measuring angle $\alpha_0$ 5. The measuring sensor 1*a*, 1*b* directly or its control system is preferably used as the computer. It is however alternatively also possible to use an external computer 21, which then notifies the measuring sensor 1*a*, 1*b* of the necessary data.

Figure 2:
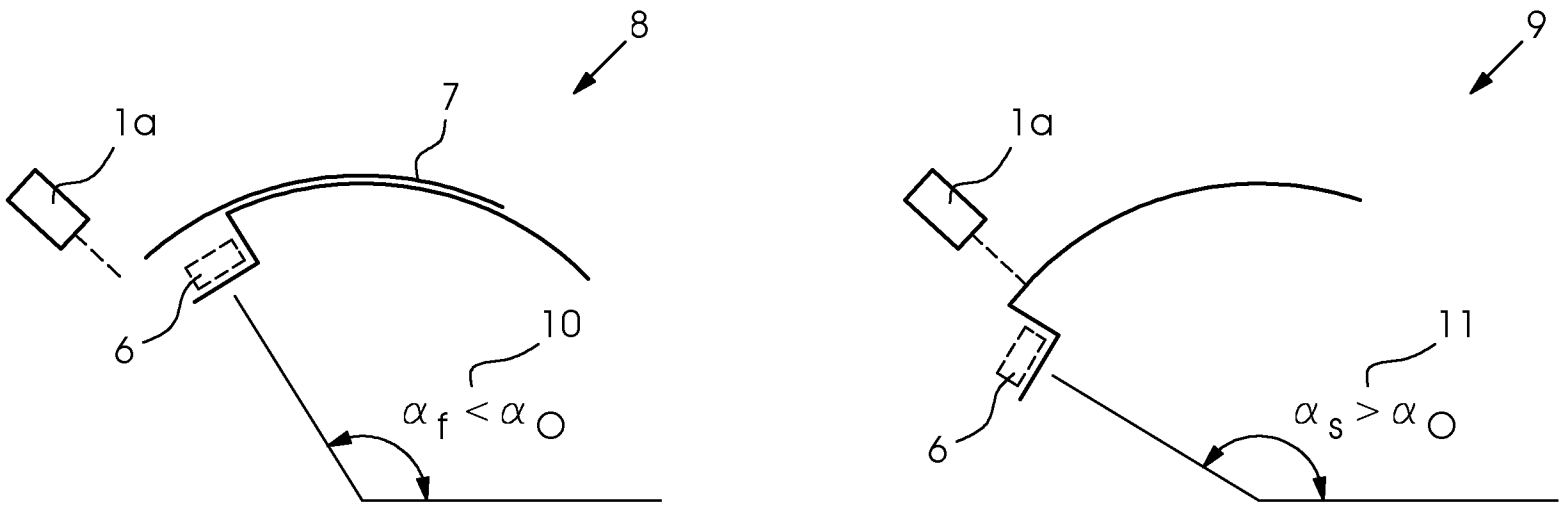
FIG. 2 is a cross-sectional view of the prior art system showing a wrong adjustment of the activation sensor.

If there is an incorrect or wrong adjustment of the activation sensor 2, the measuring sensor 1*a*, 1*b*, configured either as an optical measuring sensor 1*a* or as an ultrasonic measuring sensor 1*b*, either sporadically does not detect any object 7 and stops the printing machine even though a sheet 7 is present, or the cylinder is always detected, and consequently a sheet 7 is detected, even when no sheet 7 is present. In the first case, the adjustment takes place in such a way that measuring 8 is carried out too early, at too small a measuring angle of $\alpha_f$. In the second case, measuring 9 is carried out too late, at too large a measuring angle $\alpha_s$ 11, so that the reflector 6 is missed. The two cases are depicted in two parts of FIG. 2, with the too-early adjustment 8 on the left and the too-late adjustment 9 on the right.

Figure 4:
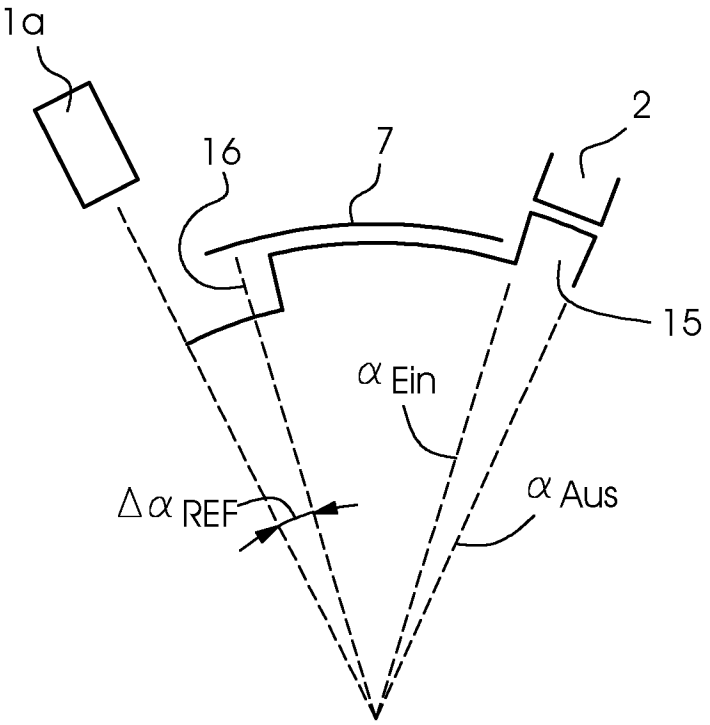
FIG. 4 is an enlarged, cross-sectional view showing the activation sensor fixedly installed according to the invention.
Figure 5:
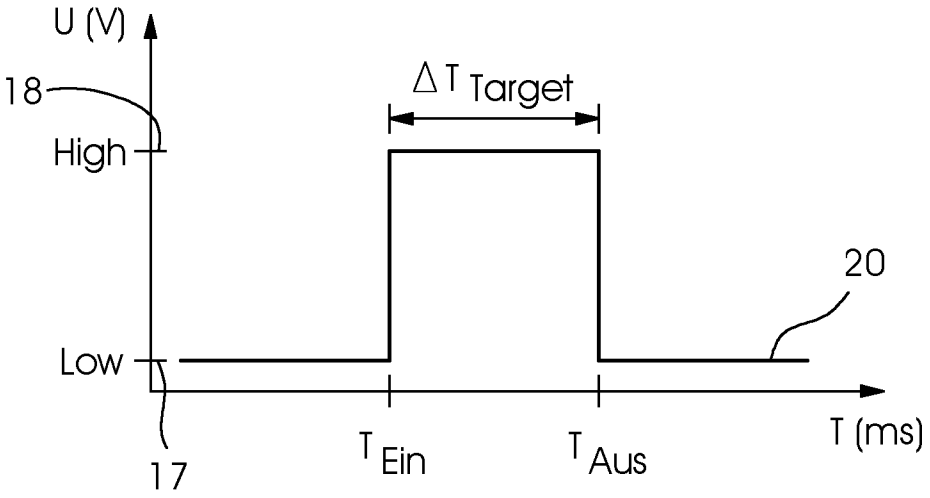
FIG. 5 is a diagram showing a square-wave signal generated by the activation sensor at the switching output.

In the method according to the invention, the activation sensor 2 is fixedly installed in the printing machine, so that, with all of the tolerances occurring, a target 15, for example an incoming printed sheet 7, activates the activation sensor 2 before the ideal measuring point at a time 16. FIG. 4 shows an example of such a fixedly installed activation sensor 2. The activation sensor 2 then generates a square-wave signal 20 at a switching output by outputting: HIGH 18 if the target 16 is detected, and otherwise LOW 17. In FIG. 5, such a square-wave signal 20 is shown. Because of the premature activation, there is a constant angular difference $\Delta\alpha_{REF}$ between the ideal measuring point at the time 16 and the falling edge of the activation signal. This angular difference $\Delta\alpha_{REF}$ depends on the tolerances of the measuring sensor 1*a*, 1*b*, the sensor mount and the target 16, and is generally different from printing unit to printing unit.

With a known machine speed, a temporal difference can be calculated from the angular difference:

$$\Delta T_{REF} = \frac{\Delta\alpha_{REF}}{\omega},\ [T] = \text{ms},\ [\omega] = \frac{^\circ}{\text{ms}}$$

Figure 3:
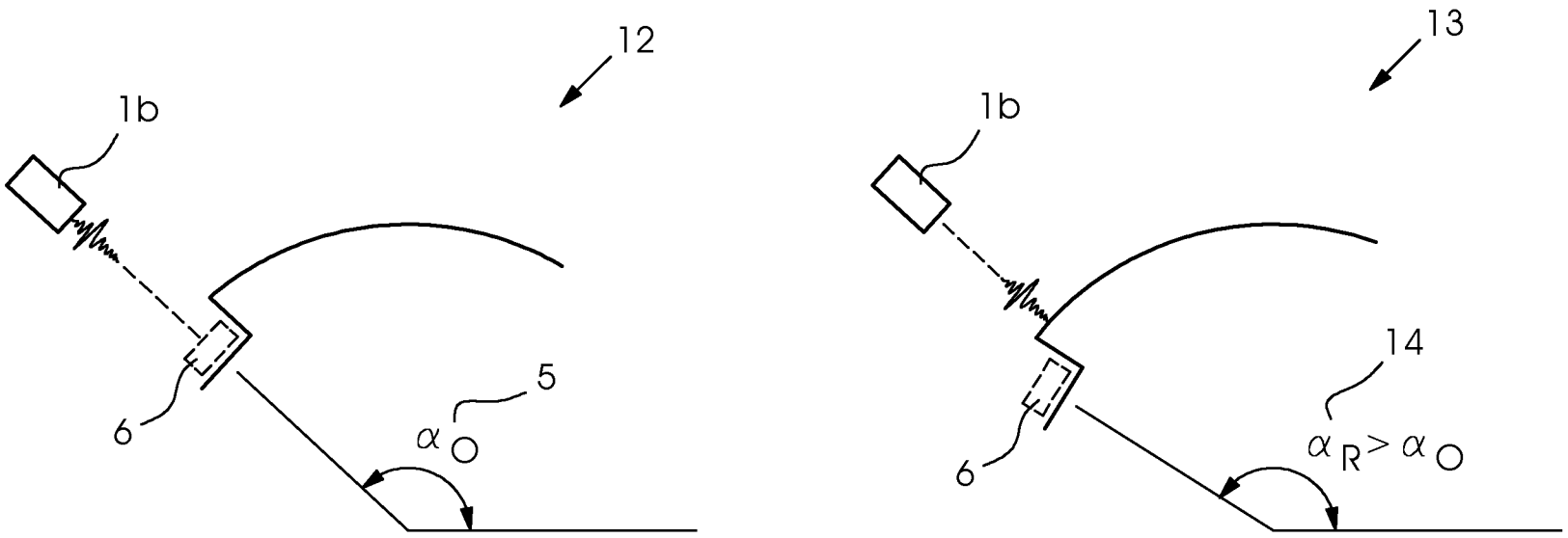
FIG. 3 is a cross-sectional view showing the calculation of the ultrasound transit time.

In a learning run, this temporal difference $\Delta T_{REF}$ is determined at a machine speed that is as slow as possible. The machine speed should be slow in order to ensure that the scanning rate of the measuring sensor 1*a*, 1*b* and electronic processing times are of little significance in comparison with the machine speed. FIG. 3 shows an example of the calculation of the ultrasound transit time of the measuring sensor 1*b*, on which the scanning rate of the measuring sensor 1*b* depends. In this learning run, it is also determined in the measuring sensor 1*a*, 1*b* how great the time period $\Delta T_{TARGET}$ in which the activation sensor detects the target 16 is at this machine speed. The time periods $\Delta T_{TARGET}$ and $\Delta T_{REF}$ are persistently stored in the measuring sensor 1*a*, 1*b*.

Both time periods scale in inverse proportion to the machine speed, i.e. if the machine speed changes by a factor r, the time period changes by 1/r. Therefore, at twice the machine speed, the time period is halved. As a result, the machine speed can be calculated and the ideal measuring point at the time 16 can be calculated in the measuring sensor 1*a*, 1*b*, i.e. the measuring sensor 1*a*, 1*b* can initiate the measuring at the ideal point in time independently of the machine speed. For this purpose, the measuring sensor 1*a*, 1*b* measures the length of the signal that is generated by the target 16 $\Delta T_{TARGET,\omega 1}$. As a result, the current machine speed can be determined by forming the ratio between the stored pulse width at the reference speed and the measured pulse width. After the falling edge of the signal 20, it is necessary to wait for the time period until the ideal measuring point at the time 16 before initiating the measuring. This time period corresponds to the stored time period for the reference speed scaled by the ratio of the current machine speed and the reference speed. The situation is represented in the following formulas:

$$\omega_1 = \omega_{REF} \times \frac{\Delta T_{TARGET,REF}}{\Delta T_{TARGET,\omega 1}}$$

-continued $$\Delta T_{REF,\omega 1} = \Delta T_{REF,\omega REF} \times \frac{\omega_{REF}}{\omega 1} = \frac{\Delta T_{TARGET,\omega 1}}{\Delta T_{TARGET,REF}} \times \Delta T_{REF,\omega REF}$$

Figure 6:
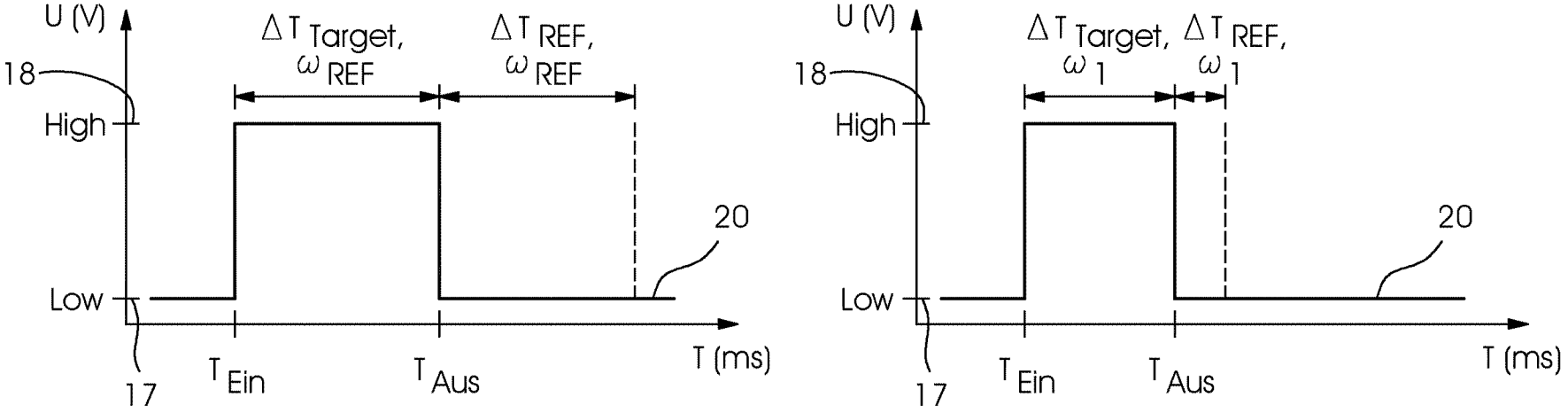
FIG. 6 is a diagram showing the ideal measuring point after the falling edge of the signal.

FIG. 6 then shows the ideal measuring point at the time 16 dependent thereon after the falling edge of the signal 20.

In an alternative embodiment, the calculation in the measuring sensor 1*a*, 1*b* may also be performed with a characteristic curve, i.e. a relationship of the length of the activation pulse and the ideal point in time of the measuring is transmitted in the form of a characteristic curve with interpolation points by the controller to the measuring sensor 1*a*, 1*b* during initialization. If the measuring sensor 1*a*, 1*b* measures an activation pulse that lies between two interpolation points, interpolation is correspondingly carried out linearly.

In a further embodiment, it is also possible to communicate the machine speed to the measuring sensor 1*a*, 1*b* by the controller of the printing machine in the form of the computer 21, instead of calculating it in the measuring sensor 1*a*, 1*b* by measuring the pulse width. However, this would have the disadvantage that there would then be an additional communication between the measuring sensor 1*a*, 1*b* and the computer 21. Furthermore, the machine speed can change quickly, for example in the case of an emergency stop, so that the speed must be communicated often or a deviation occurs between the communicated speed and the actual speed. In the case of the preferred embodiment, the determination of the machine speed takes place by measuring the pulse width $\Delta T_{TARGET}$ directly before the measuring, so that during the time period $\Delta T_{REF,\omega 1}$ the changing of the machine speed can be disregarded.

Furthermore, in a further alternative variant of an embodiment it is also possible to measure the length of the LOW signal 17 and calculate the machine speed from it, instead of the length of the pulse, that is to say the duration, for which a HIGH signal 18 is present. Since, however, the HIGH signal 18 is present for a much shorter time, specifically only about 1% of the time, the measuring of the HIGH level is thus influenced less by changes of the machine speed.

The advantages of the method according to the invention as compared with the prior art can be summarized as follows:

1. There is no longer any need for adjustment, as a result of improvement in robustness and availability of monitoring, less effort involved during installation and in the case of servicing.
2. Activation pulses that are shorter than a lower limit or longer than an upper limit can be discarded. In this case, no measuring is initiated. Such invalid durations of the activation pulse may indicate EMC disturbances or malfunctions of the activation sensor.
3. The ultrasound transit time is provided, as is shown in FIG. 3. In the prior art, the sheet running control is adjusted when the printing machine is at a standstill.

Figure 7:
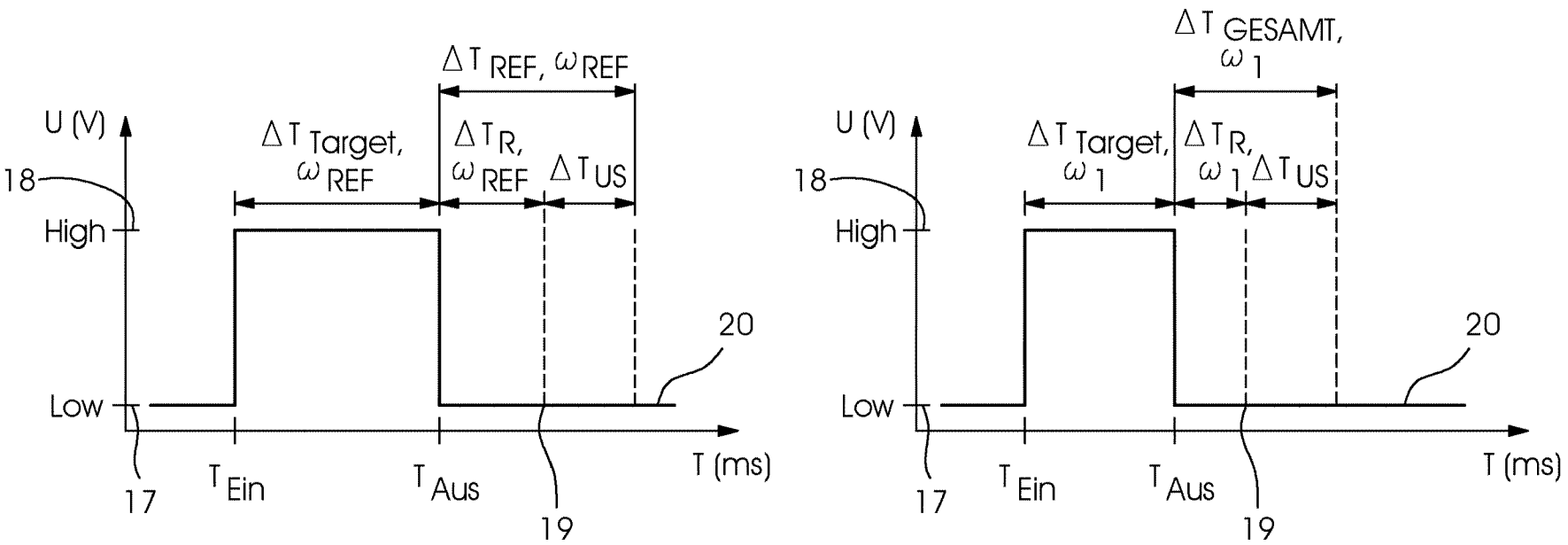
FIG. 7 is a diagram showing the provision of the ultrasound transit time.

This results in an error due to the transit time of the packet of ultrasound pulses being disregarded, in the case of an ultrasound measuring sensor 1*b*, with the error becoming all the greater as the machine speed becomes higher. This is so since the propagation speed of a packet of ultrasound pulses is much lower than the propagation of the light of an optical measuring sensor 1*a*. Therefore, at high machine speeds, the reflector 6 is still at the correct location at the point in time 12 of the activation of the ultrasonic measuring sensor 1*b*, whereas, at a time 13 when the packet of ultrasound pulses arrive at the reflector 6, the cylinder has already turned further, which results in too large a measuring angle $\alpha_R$ 14. In the case of the method according to the invention, on the other hand, the ultrasound transit time is contained in the time period $\Delta T_{REF}$ determined in the learning run. This results in a dead time, which as a constant time period $\Delta T_{US}$ is not included in the scaling, but has to be provided for each measuring speed, i.e. the correct initiation of the measuring 19 must always take place earlier by $\Delta T_{US}$, since the printing machine reaches the ideal measuring point at the time 16 while disregarding the transit time. This is shown correspondingly in FIG. 7. The ultrasound transit time is known on the basis of the distance between the measuring sensor and the ultrasound reflector 6. The situation is depicted in the following formulas:

$$\Delta T_{REF,\omega 1} = \Delta T_{REF,\omega REF} - \Delta T_{us}$$

$$\Delta T_{R,\omega 1} = \frac{\Delta T_{TARGET,\omega 1}}{\Delta T_{TARGET,\omega REF}} \times \Delta T_{R,\omega REF}$$

The following is a summary list of reference numerals and the corresponding structure used in the above description of the invention:

1*a* optical sheet running sensor
1*b* ultrasonic sheet running sensor
2 activation sensor
3 measuring with sheet
4 measuring without sheet
5 measuring angle $\alpha_0$
6 reflector
7 printed sheet
8 measuring too early
9 measuring too late
10 too small a measuring angle $\alpha_f$
11 too large a measuring angle $\alpha_s$
12 point in time of activation
13 point in time of arrival of packet of ultrasound pulses
14 too large a measuring angle $\alpha_R$
15 target
16 ideal measuring point in time
17 LOW—no target detected
18 HIGH—target detected
19 initiation of measuring
20 square-wave/activation signal
21 computer

The invention claimed is:

1. A method for computer-aided sheet running control in a sheet-fed printing machine, the method comprising:
mechanically fixedly installing an activation sensor in the printing machine without adjustment;
during a printing operation, using a measuring sensor to detect a printed sheet in the printing machine and using the activation sensor to emit an activation signal for initiating measuring performed by the measuring sensor; and
determining and compensating for temporal deviations of the activation signal.

2. The method according to claim 1, which further comprises determining the temporal deviations of the activation signal by using a duration of the activation signal at a constant speed of the sheet-fed printing machine being scaled by a factor.

3. The method according to claim 2, which further comprises using a computer to detect a duration of the activation signal at a constant speed of the sheet-fed printing machine during a learning run being separate from a normal printing operation of the sheet-fed printing machine, at the constant speed of the sheet-fed printing machine.

4. The method according to claim 3, which further comprises using the computer to determine, during the printing operation of the sheet-fed printing machine, a current speed of the sheet-fed printing machine by forming a ratio between the detected duration of the activation signal at a constant speed in the learning run and a measured duration of the activation signal during the printing operation.

5. The method according to claim 4, which further comprises calculating the factor by using a ratio of the current speed of the sheet-fed printing machine during printing operation and the constant speed of the sheet-fed printing machine in the learning run being determined.

6. The method according to claim 5, which further comprises using the measuring sensor as a computer to determine and store the detected duration of the activation signal at the constant speed in the learning run and the measured duration of the activation signal during the printing operation.

7. The method according to claim 6, which further comprises using the measuring sensor to carry out the calculation of the factor by using stored durations of the activation signal at a constant speed in the learning run, the measured duration of the activation signal during the printing operation and the constant speed of the sheet-fed printing machine in the learning run.

8. The method according to claim 2, which further comprises determining the duration of the activation signal by using a time in which the activation sensor is active or not active during a sheet run being detected.

9. The method according to claim 2, which further comprises setting the constant speed of the sheet-fed printing machine to be so low that a scanning rate of the sensors and their electronic processing times do not influence the determination of the temporal deviations of the activation signal.

10. A system for computer-aided sheet running control in a sheet-fed printing machine, the system comprising a mechanically fixedly installed activation sensor and a measuring sensor used as a computer and operated by the method according to claim 1.

* * * * *